US011842651B2

(12) United States Patent
Ramachandra et al.

(10) Patent No.: US 11,842,651 B2
(45) Date of Patent: Dec. 12, 2023

(54) SYSTEM AND METHOD FOR PROVIDING A RUNWAY AWARENESS SYSTEM FOR AN AIRCREW OF AN AIRCRAFT

(71) Applicant: HONEYWELL INTERNATIONAL INC., Charlotte, NC (US)

(72) Inventors: Sripathi Ramachandra, Bangalore (IN); Shobana Arumugam, Bangalore (IN); Anil Kumar Songa, Bangalore (IN); Mohammed Ibrahim Mohideen, Bangalore (IN); Sabu Mathew, Bangalore (IN); Ruben Carrillo, Peoria, AZ (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 98 days.

(21) Appl. No.: 16/953,444

(22) Filed: Nov. 20, 2020

(65) Prior Publication Data

US 2022/0101738 A1 Mar. 31, 2022

(30) Foreign Application Priority Data

Sep. 25, 2020 (IN) ..... 202011041659

(51) Int. Cl.
*G08G 5/02* (2006.01)
*G08G 5/00* (2006.01)

(52) U.S. Cl.
CPC ..... *G08G 5/025* (2013.01); *G08G 5/003* (2013.01); *G08G 5/0021* (2013.01)

(58) Field of Classification Search
CPC ..... G08G 5/025; G08G 5/0021; G08G 5/003; G08G 5/0043; G01C 23/00
See application file for complete search history.

(56) References Cited

U.S. PATENT DOCUMENTS

| | | | | |
|---|---|---|---|---|
| 6,690,299 | B1 * | 2/2004 | Suiter | G01C 23/005 340/975 |
| 8,633,913 | B1 * | 1/2014 | Raghu | G06F 3/01 345/173 |
| 9,189,964 | B1 * | 11/2015 | Rathinam | G01S 13/913 |
| 9,245,450 | B1 * | 1/2016 | Chiew | G08G 5/0047 |
| 9,384,586 | B1 * | 7/2016 | McCusker | G06T 15/20 |
| 9,517,844 | B2 | 12/2016 | Khatwa et al. | |
| 10,540,904 | B2 | 1/2020 | Ouellette | |
| 10,607,493 | B2 | 3/2020 | Schwartz et al. | |
| 2005/0273220 | A1 | 12/2005 | Humbard et al. | |
| 2008/0001847 | A1 * | 1/2008 | Kratchounova | H04N 13/349 345/1.1 |
| 2009/0207180 | A1 * | 8/2009 | Jardee | G09G 3/2096 345/87 |

(Continued)

*Primary Examiner* — Donald J Wallace
*Assistant Examiner* — Daniel M. Robert
(74) *Attorney, Agent, or Firm* — Lorenz & Kopf LLP

(57) ABSTRACT

Methods and systems are provided for providing a runway awareness system for an aircrew of an aircraft. The method comprises receiving a first data stream that provides operational characteristics of a primary aviation parameter on approach to the runway. A second data stream is also received that provides operational characteristics of an alternative aviation parameter on approach to the runway. The first data stream and the second data stream are then displayed in a comparative layout format on a flight display for the aircrew of the aircraft during the approach to the runway.

19 Claims, 6 Drawing Sheets

(56) References Cited

U.S. PATENT DOCUMENTS

| | | | | |
|---|---|---|---|---|
| 2011/0196598 | A1 | 8/2011 | Feyereisen et al. | |
| 2013/0120664 | A1* | 5/2013 | Bushell | G09G 3/3406 348/731 |
| 2014/0343765 | A1 | 11/2014 | Suiter et al. | |
| 2014/0350755 | A1 | 11/2014 | Caillaud et al. | |
| 2015/0120098 | A1* | 4/2015 | Catalfamo | G08G 5/025 701/16 |
| 2016/0063869 | A1 | 3/2016 | Kathirvel et al. | |
| 2016/0090193 | A1* | 3/2016 | He | B64D 45/04 340/971 |
| 2016/0155341 | A1 | 6/2016 | Gannon et al. | |
| 2016/0351058 | A1 | 12/2016 | Wischmeyer et al. | |
| 2018/0061243 | A1* | 3/2018 | Shloosh | G08G 5/0043 |
| 2019/0213890 | A1* | 7/2019 | Hosamani | B64D 45/08 |
| 2020/0013295 | A1* | 1/2020 | Moravek | G05D 1/0676 |
| 2020/0327815 | A1* | 10/2020 | Frenot | G08G 5/025 |

* cited by examiner

400

500

SYSTEM AND METHOD FOR PROVIDING A RUNWAY AWARENESS SYSTEM FOR AN AIRCREW OF AN AIRCRAFT

CROSS REFERENCE TO RELATED APPLICATION

This application claims priority to Indian Provisional Patent Application No. 202011041659, filed Sep. 25, 2020, the entire content of which is incorporated by reference herein.

TECHNICAL FIELD

The present invention generally relates to aviation operations, and more particularly relates to a system and method for providing a runway awareness system for an aircrew of an aircraft.

BACKGROUND

The risk of overrun during landing may be reduced by providing a timely and distinctive alert to the flight crew when the airplane is at risk of not being able to stop on the available distance to the end of the runway. Hence, there is a need for a system and method for providing a runway awareness system for an aircrew of an aircraft.

BRIEF SUMMARY

This summary is provided to describe select concepts in a simplified form that are further described in the Detailed Description. This summary is not intended to identify key or essential features of the claimed subject matter, nor is it intended to be used as an aid in determining the scope of the claimed subject matter.

A method is provided for providing runway awareness for an aircrew of an aircraft. The method comprises: receiving a first data stream that provides operational characteristics of a primary aviation parameter on approach to the runway; receiving a second data stream that provides operational characteristics of an alternative aviation parameter on approach to the runway; and displaying the first data stream and the second data stream in a comparative layout format on a flight display for the aircrew of the aircraft during the approach to the runway.

A system is provided for providing a runway awareness for an aircrew of an aircraft. The system comprises: a flight management system (FMS) located onboard the aircraft, where the FMS, receives a first data stream that provides operational characteristics of a primary aviation parameter on approach to the runway, and receives a second data stream that provides operational characteristics of an alternative aviation parameter on approach to the runway; and a visual display device that receives the first and second data streams from the FMS and displays the first data stream and the second data stream in a comparative layout format on a flight display for the aircrew of the aircraft during the approach to the runway.

Furthermore, other desirable features and characteristics of the method and system will become apparent from the subsequent detailed description and the appended claims, taken in conjunction with the accompanying drawings and the preceding background.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Before proceeding further, it is noted that, for convenience, the following description is in the context of an aircraft environment. It will be appreciated, however, that the claimed invention is not limited to any particular aircraft environment but may be implemented in numerous other vehicular and non-vehicular environments.

Figure 1:
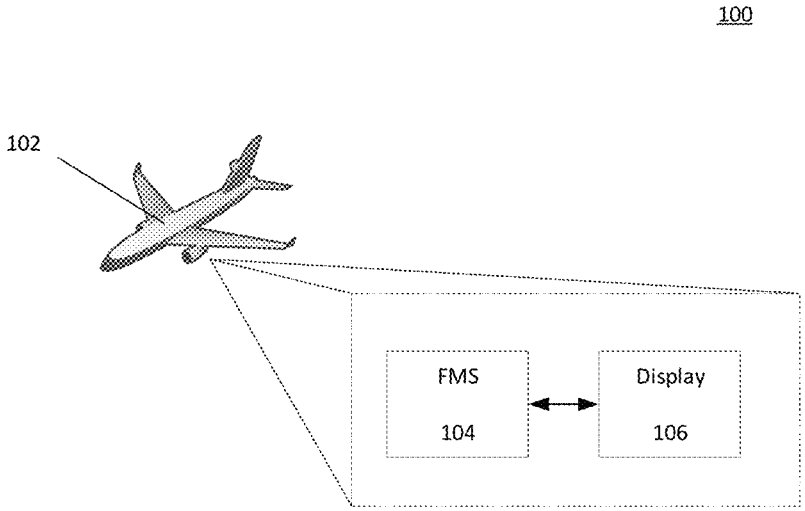
FIG. 1 shows a diagram of an in-flight aircraft that contains an onboard flight management system (FMS) along with a visual display system in accordance with one embodiment.

Turning now to FIG. 1, a diagram 100 is shown of an in-flight aircraft 102 that contains an onboard flight management system (FMS) 104 along with a visual data system 106 that is accessed by the FMS 104 in accordance with one embodiment. In alternative embodiments, the visual data system 106 may be integrated as part of the FMS 104. The FMS 104, as is generally known, is a specialized computer that automates a variety of in-flight tasks such as in-flight management of the flight plan. Using various sensors such as global positioning system (GPS), the FMS 104 determines the aircraft's position and guides the aircraft along its flight plan using its navigation database. From the cockpit, the FMS 104 is normally controlled through a visual display device such as a control display unit (CDU) which incorporates a small screen, a keyboard or a touchscreen. The FMS 104 displays the flight plan and other critical flight data to the aircrew during operation on an onboard display device 106.

The FMS 104 may have a built-in electronic memory system that contains a navigation database. The navigation database contains elements used for constructing a flight plan. In some embodiments, the navigation database may be separate from the FMS 104 and located onboard the aircraft while in other embodiments the navigation database may be located on the ground and relevant data provided to the FMS 104 via a (non-illustrated) communications link with a (non-illustrated) ground station. The navigation database used by the FMS 104 may typically include: waypoints/intersections; airways; radio navigation aids/navigation beacons; airports; runway; standard instrument departure (SID) information; standard terminal arrival (STAR) information; holding patterns; and instrument approach procedures. Additionally, other waypoints may also be manually defined by pilots along the route.

The flight plan is generally determined on the ground before departure by either the pilot or a dispatcher for the owner of the aircraft. It may be manually entered into the FMS 104 or selected from a library of common routes. In other embodiments the flight plan may be loaded via a communications data link from an airline dispatch center. During preflight planning, additional relevant aircraft performance data may be entered including information such as: gross aircraft weight; fuel weight and the center of gravity of the aircraft. The aircrew may use the FMS 104 to modify the plight flight plan before takeoff or even while in flight for variety of reasons. Such changes may be entered via the CDU. Once in flight, the principal task of the FMS 104 is to accurately monitor the aircraft's position. This may use a GPS, a VHF omnidirectional range (VOR) system, or other similar sensor in order to determine and validate the aircraft's exact position. The FMS 104 constantly cross checks among various sensors to determine the aircraft's position with accuracy.

Additionally, the FMS 104 may be used to perform advanced vertical navigation (VNAV) functions. The purpose of VNAV is to predict and optimize the vertical path of the aircraft. The FMS 104 provides guidance that includes control of the pitch axis and of the throttle of the aircraft. In order to accomplish these tasks, the FMS 104 has detailed flight and engine model data of the aircraft. Using this information, the FMS 104 may build a predicted vertical descent path for the aircraft. A correct and accurate implementation of VNAV has significant advantages in fuel savings and on-time efficiency.

In exemplary embodiments, an existing flight management computer (FMC) (or flight management system (FMS)) onboard an aircraft is utilized to communicate data between existing onboard avionics systems or line-replaceable units (LRUs) and another module coupled to the FMC, which supports or otherwise performs new flight management functionality that is not performed by the FMC. For example, a multifunction control and display unit (MCDU) may support or otherwise perform new flight management functionality based on data from onboard avionics or LRUs received via the FMC. In this regard, the FMC is configured to receive operational or status data from one or more avionics systems or LRUs onboard the aircraft at corresponding avionics interfaces and convert one or more characteristics of the operational data to support communicating the operational data with the MCDU. For purposes of explanation, the subject matter may primarily be described herein in the context of converting operational data received from onboard avionics or LRUs in a first format (e.g., an avionics bus format) into another format supported by the interface with the MCDU, the subject matter described herein is not necessarily limited to format conversions or digital reformatting, and may be implemented in an equivalent manner for converting between other data characteristics, such as, for example, different data rates, throughputs or bandwidths, different sampling rates, different resolutions, different data compression ratios, and the like.

Figure 2:
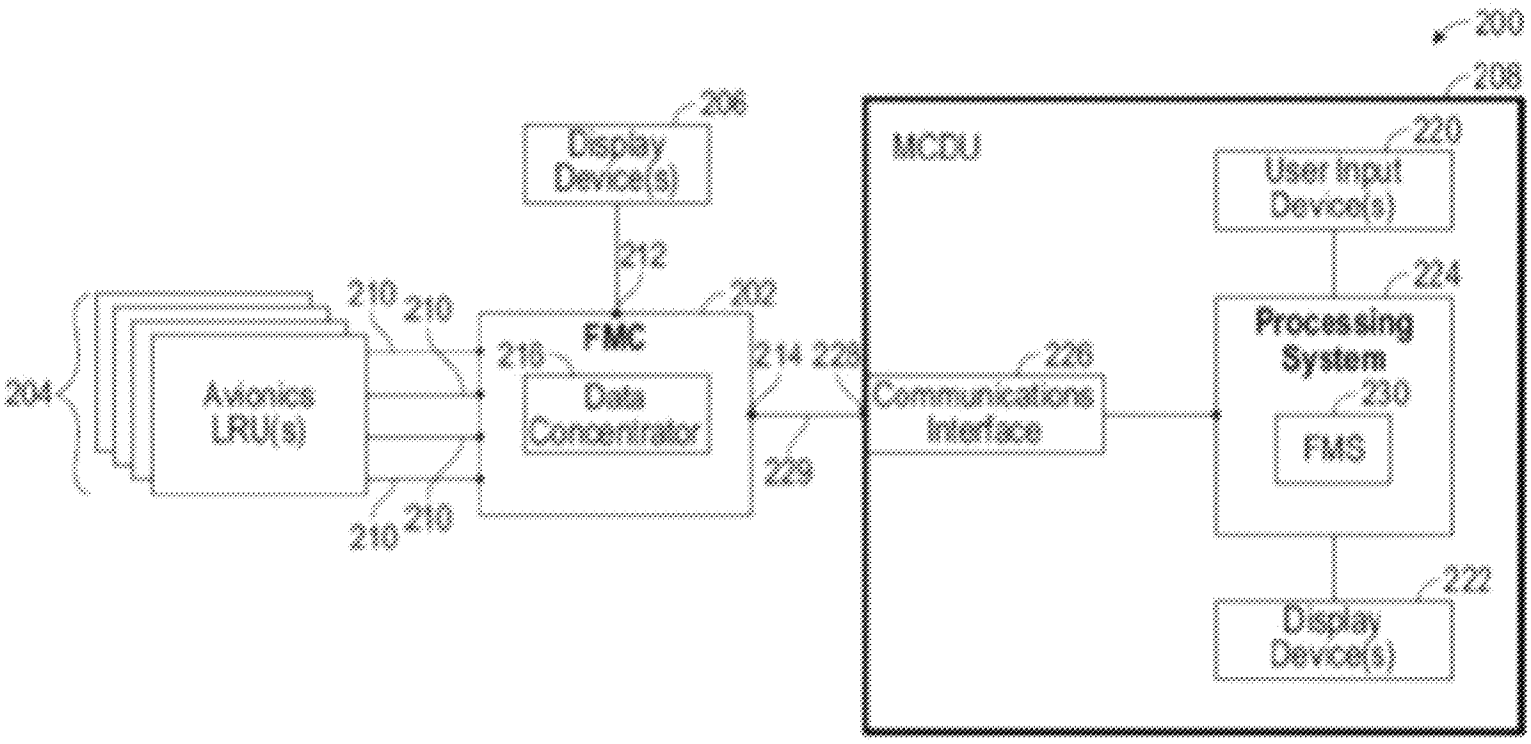
FIG. 2 shows a diagram of an aircraft system that includes a flight management computing (FMC) module that is coupled to a plurality of onboard avionics line replacement units (LRU) and a visual display device in accordance with one embodiment.

FIG. 2 depicts an exemplary embodiment of an aircraft system 200 suitable for implementation onboard an aircraft 102 shown previously in FIG. 1. The illustrated aircraft system 200 includes a flight management computing module 202 communicatively coupled to a plurality of onboard avionics LRUs 204, one or more display devices 206, and a multifunction computing module 208. It should be appreciated that FIG. 2 depicts a simplified representation of the aircraft system 200 for purposes of explanation, and FIG. 2 is not intended to limit the subject matter in any way.

The flight management computing module 202 generally represents the FMC, the FMS, or other hardware, circuitry, logic, firmware and/or other components installed onboard the aircraft and configured to perform various tasks, functions and/or operations pertaining to flight management, flight planning, flight guidance, flight envelope protection, four-dimensional trajectory generation or required time of arrival (RTA) management, and the like. Accordingly, for purposes of explanation, but without limiting the functionality performed by or supported at the flight management computing module 202, the flight management computing module 202 may alternatively be referred to herein as the FMC. The FMC 202 includes a plurality of interfaces 210 configured to support communications with the avionics LRUs 204 along with one or more display interfaces 212 configured to support coupling one or more display devices 206 to the FMC 202. In the illustrated embodiment, the FMC 202 also includes a communications interface 214 that supports coupling the multifunction computing module 208 to the FMC 202.

The FMC 202 generally includes a processing system designed to perform flight management functions, and potentially other functions pertaining to flight planning, flight guidance, flight envelope protection, and the like. Depending on the embodiment, the processing system could be realized as or otherwise include one or more processors, controllers, application specific integrated circuits, programmable logic devices, discrete gate or transistor logics, discrete hardware components, or any combination thereof. The processing system of the FMC 202 generally includes or otherwise accesses a data storage element (or memory), which may be realized as any sort of non-transitory short or long term storage media capable of storing programming instructions for execution by the processing system of the FMC 202. In exemplary embodiments, the data storage element stores or otherwise maintains code or other computer-executable programming instructions that, when read and executed by the processing system of the FMC 202, cause the FMC 202 to implement, generate, or otherwise support a data concentrator application 216 that performs certain tasks, operations, functions, and processes described herein.

The avionics LRUs 204 generally represent the electronic components or modules installed onboard the aircraft that support navigation, flight planning, and other aircraft control functions in a conventional manner and/or provide real-time data and/or information regarding the operational status of the aircraft to the FMC 202. For example, practical embodiments of the aircraft system 200 will likely include one or more of the following avionics LRUs 204 suitably configured to support operation of the aircraft: a weather system, an air traffic management system, a radar system, a traffic avoidance system, an autopilot system, an autothrottle (or autothrust) system, a flight control system, hydraulics systems, pneumatics systems, environmental systems, electrical systems, engine systems, trim systems, lighting systems, crew alerting systems, electronic checklist systems, and/or another suitable avionics system.

In exemplary embodiments, the avionics interfaces 210 are realized as different ports, terminals, channels, connectors, or the like associated with the FMC 202 that are connected to different avionics LRUs 204 via different wiring, cabling, buses, or the like. In this regard, the interfaces 210 may be configured to support different communications protocols or different data formats corresponding to the respective type of avionics LRU 204 that is connected to a particular interface 210. For example, the FMC 202 may communicate navigation data from a navigation system via a navigation interface 210 coupled to a data bus supporting the ARINC 424 (or A424) standard, the ARINC 629 (or A629) standard, the ARINC 422 (or A422) standard, or the like. As another example, a datalink system or other communications LRU 204 may utilize an ARINC 619 (or A619) compatible avionics bus interface for communicating datalink communications or other communications data with the FMC 202.

The display device(s) 206 generally represent the electronic displays installed onboard the aircraft in the cockpit, and depending on the embodiment, could be realized as one or more monitors, screens, liquid crystal displays (LCDs), a light emitting diode (LED) displays, or any other suitable electronic display(s) capable of graphically displaying data and/or information provided by the FMC 202 via the display interface(s) 212. Similar to the avionics interfaces 210, the display interfaces 212 are realized as different ports, terminals, channels, connectors, or the like associated with the FMC 202 that are connected to different cockpit displays 206 via corresponding wiring, cabling, buses, or the like. In one or more embodiments, the display interfaces 212 are configured to support communications in accordance with the ARINC 661 (or A661) standard. In one embodiment, the FMC 202 communicates with a lateral map display device 206 using the ARINC 702 (or A702) standard.

In exemplary embodiments, the multifunction computing module 208 is realized as a multifunction control and display unit (MCDU) that includes one or more user interfaces, such as one or more input devices 220 and/or one or more display devices 222 (shown previously as 106 in FIG. 1), a processing system 224, and a communications module 226. The MCDU 208 generally includes at least one user input device 220 that is coupled to the processing system 224 and capable of receiving inputs from a user, such as, for example, a keyboard, a key pad, a mouse, a joystick, a directional pad, a touchscreen, a touch panel, a motion sensor, or any other suitable user input device or combinations thereof. The display device(s) 222 may be realized as any sort of monitor, screen, LCD, LED display, or other suitable electronic display capable of graphically displaying data and/or information under control of the processing system 224.

The processing system 224 generally represents the hardware, circuitry, logic, firmware and/or other components of the MCDU 208 configured to perform the various tasks, operations, functions and/or operations described herein. Depending on the embodiment, the processing system 224 may be implemented or realized with a general purpose processor, a microprocessor, a controller, a microcontroller, a state machine, an application specific integrated circuit, a field programmable gate array, any suitable programmable logic device, discrete gate or transistor logic, discrete hardware components, or any combination thereof, designed to perform the functions described herein. Furthermore, the steps of a method or algorithm described in connection with the embodiments disclosed herein may be embodied directly in hardware, in firmware, in a software module executed by the processing system 224, or in any practical combination thereof. In this regard, the processing system 224 includes or accesses a data storage element (or memory), which may be realized using any sort of non-transitory short or long term storage media, and which is capable of storing code or other programming instructions for execution by the processing system 224. In exemplary embodiments described herein, the code or other computer-executable programming instructions, when read and executed by the processing system 224, cause the processing system 224 to implement with an FMS 230 (shown previously as 104 in FIG. 1) additional tasks, operations, functions, and processes described herein.

The communications module 226 generally represents the hardware, module, circuitry, software, firmware and/or combination thereof that is coupled between the processing system 224 and a communications interface 228 of the MCDU 208 and configured to support communications between the MCDU 208 and the FMC 202 via an electrical connection 229 between the MCDU communications interface 228 and the FMC communications interface 214. For example, in one embodiment, the communications module 226 is realized as an Ethernet card or adapter configured to support communications between the FMC 202 and the MCDU 208 via an Ethernet cable 229 provided between Ethernet ports 214, 228. In other embodiments, the communications module 226 is configured to support communications between the FMC 202 and the MCDU 208 in accordance with the ARINC 429 (A429) standard via an A429 data bus 229 provided between A429 ports 214, 228 of the respective modules 202, 208. In yet other embodiments, the communications module 226 is configured to support communications between the FMC 202 and the MCDU 208 in accordance with the ARINC 422 (A422) standard via an A422 data bus 229 provided between A422 ports 214, 228 of the respective modules 202, 208. In yet other embodiments, the communications module 226 is configured to support communications between the FMC 202 and the MCDU 208 in accordance with the ARINC 739 (A739) standard via an A739 data bus 229 provided between A739 ports 214, 228 of the respective modules 202, 208.

In various embodiments, the FMC 202 and MCDU 208 communicate using a different communications protocol or standard than one or more of the avionics LRUs 204 and/or the display devices 206. In such embodiments, to support communications of data between the MCDU 208 and those LRUs 204 and/or display devices 206, the data concentrator application 216 at the FMC 202 converts data from one format to another before retransmitting or relaying that data to its destination. For example, the data concentrator application 216 may convert data received from an avionics LRU 204 to the A429 or Ethernet format before providing the data to the MCDU 208, and vice versa. Additionally, in exemplary embodiments, the FMC 202 validates the data received from an avionics LRU 204 before transmitting the data to the MCDU 208. For example, the FMC 202 may perform debouncing, filtering, and range checking, and/or the like prior to converting and retransmitting data from an avionics LRU 204.

It should be noted that although the subject matter may be described herein in the context of the multifunction computing module 208 being realized as an MCDU, in alternative embodiments, the multifunction computing module 208 could be realized as an electronic flight bag (EFB) or other mobile or portable electronic device. In such embodiments, an EFB capable of supporting an FMS 230 application may be connected to an onboard FMC 202 using an Ethernet cable 229 to support flight management functionality from the EFB in an equivalent manner as described herein in the context of the MCDU.

In one or more embodiments, the MCDU 208 stores or otherwise maintains programming instructions, code, or other data for programming the FMC 202 and transmits or otherwise provides the programming instructions to the FMC 202 to update or otherwise modify the FMC 202 to implement the data concentrator application 216. For example, in some embodiments, upon establishment of the connection 229 between modules 202, 208, the MCDU 208 may automatically interact with the FMC 202 and transmit or otherwise provide the programming instructions to the FMC 202, which, in turn, executes the instructions to implement the data concentrator application 216. In some embodiments, the data concentrator application 216 may be implemented in lieu of flight management functionality by the MCDU 208 reprogramming the FMC 202. In other embodiments, the FMC 202 may support the data concentrator application 216 in parallel with flight management functions. In this regard, the FMC 202 may perform flight management functions, while the FMS 230 application on the MCDU 208 supplements the flight management functions to provide upgraded flight management functionality within the aircraft system 200.

A "runway overrun and awareness system (ROAAS)" provides display and alerting that helps increase pilot situational awareness and decrease workload by providing information on predicted touch down points, stopping points, the selected runway and the available landing distance using manufacturer provided performance metrics. The data is determined mainly with current aircraft configuration that includes speed, position, trajectory, flight path vector, runway condition, autobrake selection etc. The data is compiled and relayed as both visual and aural alerts to the flight crew. ROAAS may also point to the appropriate runway to land based on the flaps position and descending speed. However, ROAAS is intended as a safety net ROAAS does not alleviate crew responsibility to perform a safe landing.

An advantage of some embodiments all a ROAAS that can comparatively allow the user to visualize ROAAS data in comparison to two different set of inputs. The inputs may come from various sources such as avionics sensors, databases (e.g., NAVDB, Terrain DB), etc. This allows a pilot to visualize ROAAS data momentarily or until the pilot completes the landing based on the need. Typically, ROAAS data gets displayed just before landing in an approach area to the runway. In other embodiments, ROAAS along with comparative data may be displayed outside of an approach area. The ROAAS may be made to provide predictive comparative data upon request by the user.

Figure 3:
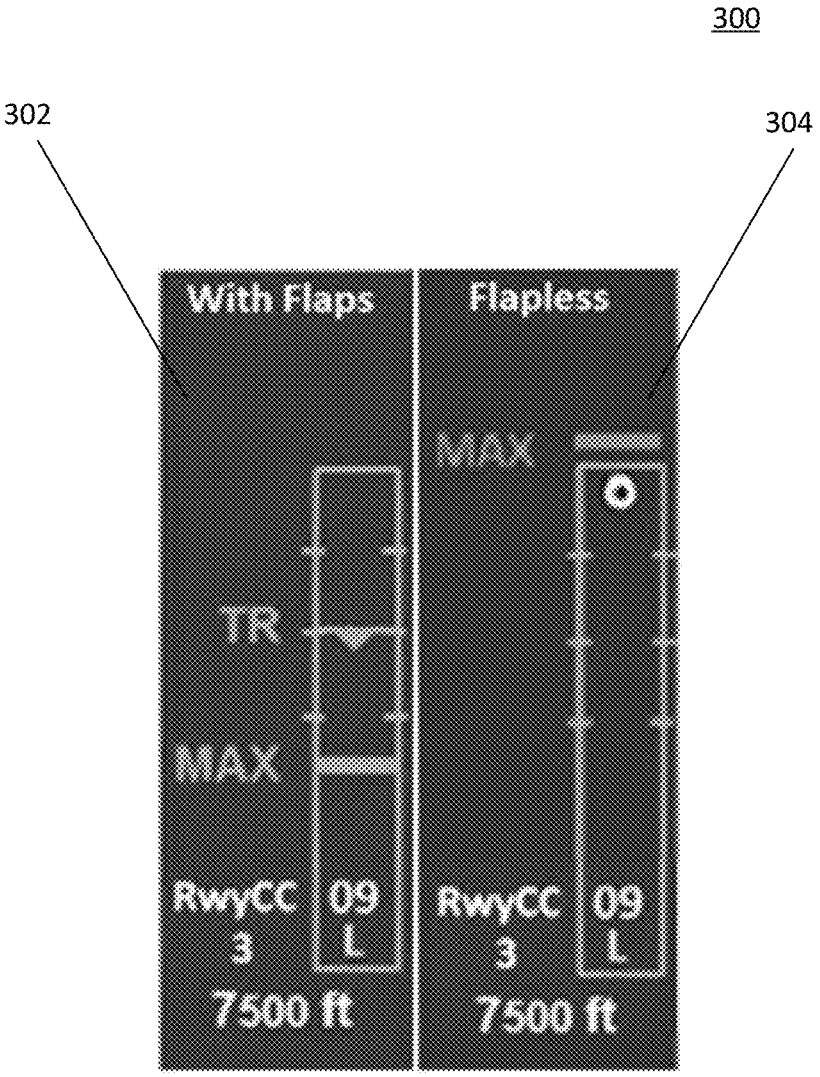
FIG. 3 shows a comparative system display of a with flaps and a flap less condition of an aircraft in accordance with one embodiment.

Various examples exist for situations where users would like to visualize the ROAAS data comparatively. For example, some embodiments could be used to comparatively display aircraft performance with flaps deployed compared with a flap less condition. Turning now to FIG. 3, a comparative system display 300 is shown with a flaps condition 302 compared to a flap less condition 304 of an aircraft in accordance with one embodiment. This display allows the pilot to comparatively analyze/understand how different landing approaches will perform with FLAPS working and in a FLAPLESS condition.

Figure 4:
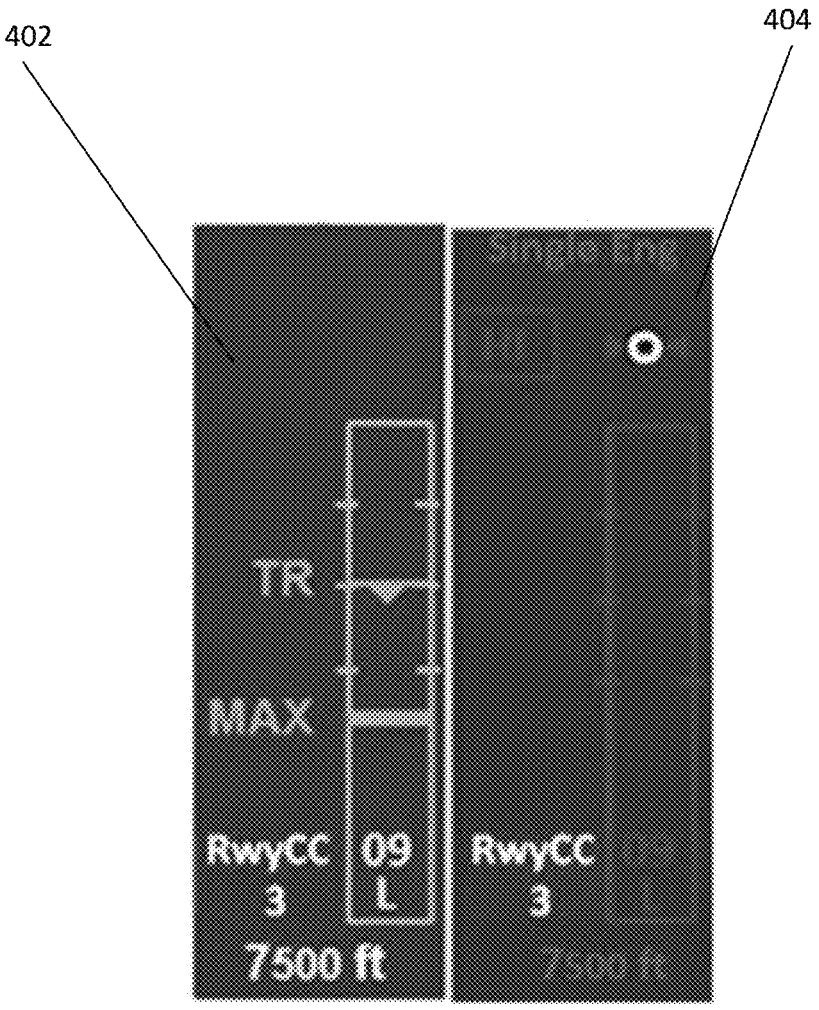
FIG. 4 shows a comparative system display of a normal operation and engine out emergency condition in accordance with one embodiment.

In another example, a pilot would like to visualize the ROAAS data for an emergency situation that requires engine to be switched off for an emergency landing. Turning now to FIG. 4, a comparative system display 400 is shown with normal operating conditions 402 compared to single engine operations in an emergency situation 404 in accordance with one embodiment. In this example, the pilot can visualize ROAAS data comparatively to understand/analyze different landing approaches with and without and engine out.

Figure 5:
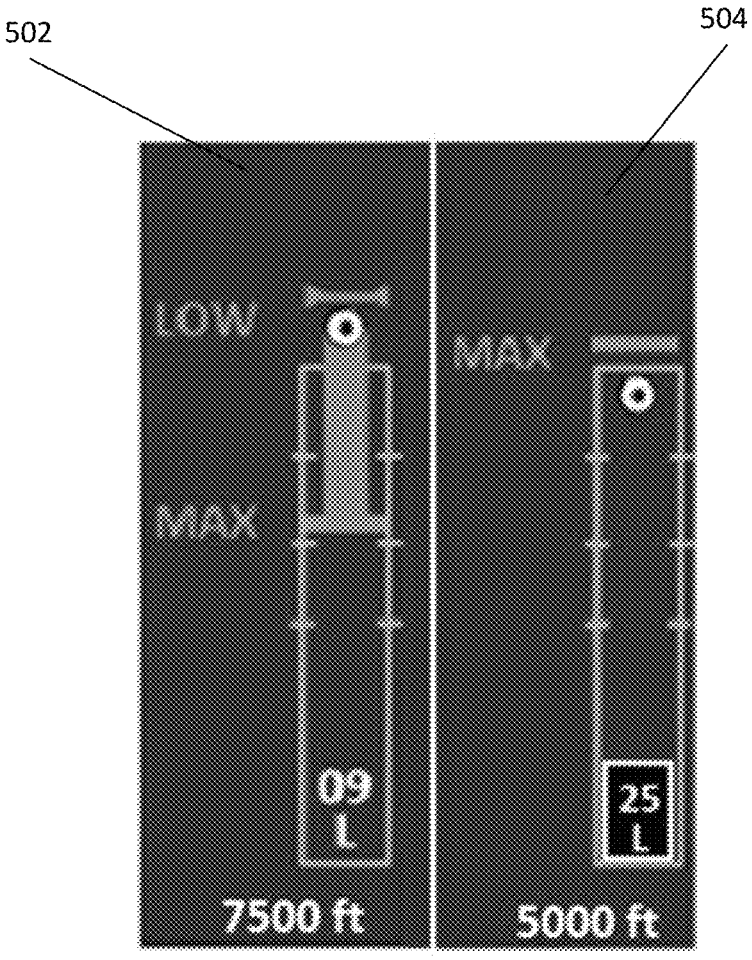
FIG. 5 shows a comparative system display of a primary and an alternative runway in accordance with one embodiment.

In another example, a pilot would like to visualize ROAAS data comparatively between a destination runway and an alternative runway. Turning now to FIG. 5, a comparative system display 500 is shown with an assigned runway 502 compared to an alternative destination runway 504 in accordance with one embodiment. In this example, the pilot may visualize any potential changes to the flight plan with an alternative destination runway along with its respective characteristics. In this example, the pilot may select a different approach runway with different conditions based on his needs. In other embodiments, the display may show multiple runways for comparison by the pilot.

In other examples, a pilot would like to experiment with modifications to the plan flight and review its effects on fuel/time efficiency. Predictive ROAAS data that is comparatively displayed allows the pilot to visualize changes in arrival, changes in descent speeds, modifying descent constraints, etc. and the corresponding effects on efficiency. The comparative ROAAS data display will help the pilot to analyze and make appropriate decisions in any changes to the flight plan. In other embodiments, the system and methods may be used for departure scenarios as well and not just be limited to approaches and landings by the aircraft.

Figure 6:
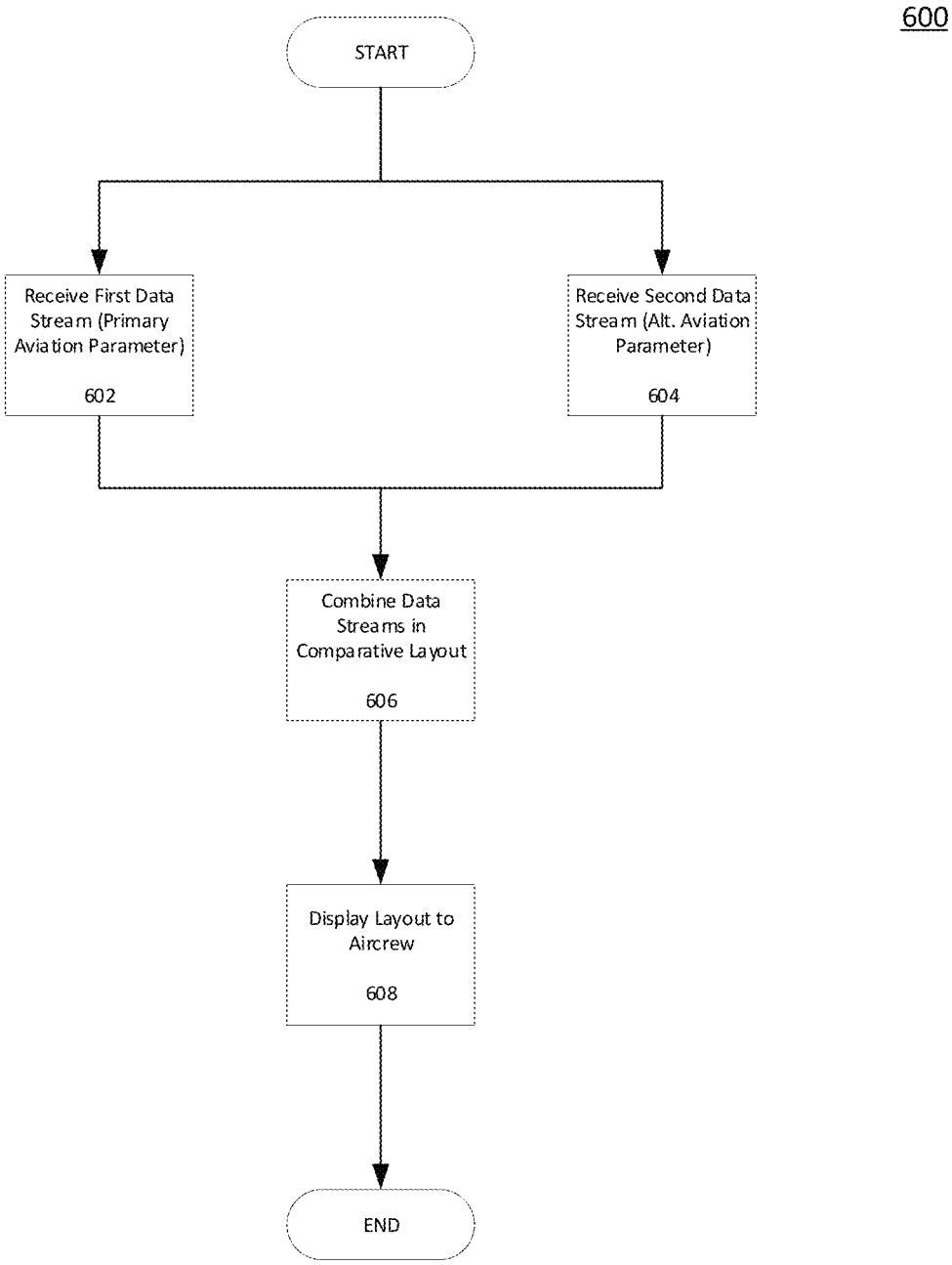
FIG. 6 shows a flowchart of a method for providing runway awareness for an aircrew of an aircraft in accordance with one embodiment.

Turning now to FIG. 6, a flowchart 600 is shown for a method for providing runway awareness for an aircrew of an aircraft. The method includes receiving a first data stream that provides operational characteristics of a primary aviation parameter on approach to the runway 602. Also, a second data stream is received that provides operational characteristics of an alternative aviation parameter on approach to the runway 604. The data streams are combined in a comparative layout format 606 and displayed on a flight display device for the aircrew of the aircraft during approach to the runway 608.

Techniques and technologies may be described herein in terms of functional and/or logical block components, and with reference to symbolic representations of operations, processing tasks, and functions that may be performed by various computing components or devices. Such operations, tasks, and functions are sometimes referred to as being computer-executed, computerized, software-implemented, or computer-implemented. In practice, one or more processor devices can carry out the described operations, tasks, and functions by manipulating electrical signals representing data bits at memory locations in the system memory, as well as other processing of signals. The memory locations where data bits are maintained are physical locations that have particular electrical, magnetic, optical, or organic properties corresponding to the data bits. It should be appreciated that the various block components shown in the figures may be realized by any number of hardware, software, and/or firmware components configured to perform the specified functions. For example, an embodiment of a system or a component may employ various integrated circuit components, e.g., memory elements, digital signal processing elements, logic elements, look-up tables, or the like, which may carry out a variety of functions under the control of one or more microprocessors or other control devices.

When implemented in software or firmware, various elements of the systems described herein are essentially the code segments or instructions that perform the various tasks. The program or code segments can be stored in a processor-readable medium or transmitted by a computer data signal embodied in a carrier wave over a transmission medium or communication path. The "computer-readable medium", "processor-readable medium", or "machine-readable medium" may include any medium that can store or transfer information. Examples of the processor-readable medium include an electronic circuit, a semiconductor memory device, a ROM, a flash memory, an erasable ROM (EROM), a floppy diskette, a CD-ROM, an optical disk, a hard disk, a fiber optic medium, a radio frequency (RF) link, or the like. The computer data signal may include any signal that can propagate over a transmission medium such as electronic network channels, optical fibers, air, electromagnetic paths, or RF links. The code segments may be downloaded via computer networks such as the Internet, an intranet, a LAN, or the like.

The following description refers to elements or nodes or features being "connected" or "coupled" together. As used herein, unless expressly stated otherwise, "coupled" means that one element/node/feature is directly or indirectly joined to (or directly or indirectly communicates with) another element/node/feature, and not necessarily mechanically. Likewise, unless expressly stated otherwise, "connected" means that one element/node/feature is directly joined to (or directly communicates with) another element/node/feature, and not necessarily mechanically. Thus, additional intervening elements, devices, features, or components may be present in an embodiment of the depicted subject matter.

In addition, certain terminology may also be used in the following description for the purpose of reference only, and thus are not intended to be limiting. For example, terms such as "upper", "lower", "above", and "below" refer to directions in the drawings to which reference is made. Terms such as "front", "back", "rear", "side", "outboard", and "inboard" describe the orientation and/or location of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second", and other such numerical terms referring to structures do not imply a sequence or order unless clearly indicated by the context.

For the sake of brevity, conventional techniques related to signal processing, data transmission, signaling, network control, and other functional aspects of the systems (and the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in an embodiment of the subject matter.

Some of the functional units described in this specification have been referred to as "modules" in order to more particularly emphasize their implementation independence. For example, functionality referred to herein as a module may be implemented wholly, or partially, as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices, or the like. Modules may also be implemented in software for execution by various types of processors. An identified module of executable code may, for instance, comprise one or more physical or logical modules of computer instructions that may, for instance, be organized as an object, procedure, or function. Nevertheless, the executables of an identified module need not be physically located together but may comprise disparate instructions stored in different locations that, when joined logically together, comprise the module and achieve the stated purpose for the module. Indeed, a module of executable code may be a single instruction, or many instructions, and may even be distributed over several different code segments, among different programs, and across several memory devices. Similarly, operational data may be embodied in any suitable form and organized within any suitable type of data structure. The operational data may be collected as a single data set or may be distributed over different locations including over different storage devices, and may exist, at least partially, merely as electronic signals on a system or network.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A method for providing runway awareness for an aircrew of an aircraft, comprising:

receiving a first data stream that provides operational characteristics of a primary aviation configuration parameter for the aircraft during an approach to the runway;

receiving a second data stream that provides operational characteristics of an alternative configuration of the primary aviation configuration parameter for the aircraft during the approach to the runway;

displaying the first data stream and the second data stream in separate dual parallel displays arranged in a comparative layout format for the aircrew of the aircraft during the approach to the runway, where the first data stream is displayed in a first separate display and the second data stream is displayed in a second separate display; and selecting a flight operation based on the comparative layout of the primary aviation configuration parameter and the alternative configuration of the primary aviation configuration parameter in the separate dual parallel displays.

2. The method of claim 1, where the primary aviation configuration parameter for the aircraft comprises a flap position for the aircraft.

3. The method of claim 1, where the alternative aviation configuration parameter for the aircraft comprises an engine operational status for the aircraft.

4. The method of claim 1, where the alternative aviation configuration parameter for the aircraft comprises a descent speed for the aircraft.

5. The method of claim 1, where the alternative aviation configuration parameter for the aircraft is predictive of possible conditions of the approach to the runway.

6. The method of claim 1, where alternative aviation configuration parameter for the aircraft reflects a change to an alternative runway.

7. The method of claim 1, where the alternative aviation configuration parameter for the aircraft reflects a change to an approach pattern of the aircraft.

8. The method of claim 1, where the separate dual parallel displays comprise a two-dimensional (2-D) display system.

9. The method of claim 1, where the separate dual parallel displays comprise a three-dimensional (3-D) display system.

10. The method of claim 1, where the separate dual parallel displays comprise a head up display (HUD) system.

11. The method of claim 1, where the separate dual parallel displays highlight the difference between the first data stream and the second data stream in the comparative layout format.

12. The method of claim 1, where the separate dual parallel displays pop up automatically on the flight display for the aircrew during the approach to the runway.

13. The method of claim 1, where the display may be brought up manually on the flight display for the aircrew prior to the approach to the runway.

14. A system for providing a runway awareness for an aircrew of an aircraft, comprising:

a flight management system (FMS) located onboard the aircraft, where the FMS, receives a first data stream that provides operational characteristics of a primary aviation configuration parameter for the aircraft during an approach to the runway, and receives a second data stream that provides operational characteristics of an alternative configuration of the primary aviation configuration parameter for the aircraft during the approach to the runway; and a visual display device that receives the first and second data streams from the FMS and displays the first data stream and the second data stream in separate dual parallel displays arranged in a comparative layout format for the aircrew of the aircraft during the approach to the runway, where the first data stream is displayed in a first separate display and the second data stream is displayed in a second separate display.

15. The system of claim 14, where the separate dual parallel displays comprise a two-dimensional (2-D) display system.

16. The system of claim 14, where the separate dual parallel displays comprise a three-dimensional (3-D) display system.

17. The system of claim 14, where the separate dual parallel displays comprise a head up display (HUD) system.

18. The system of claim 14, where the separate dual parallel displays highlight the difference between the first data stream and the second data stream in the comparative layout format.

19. The system of claim 14, where the display on the separate dual parallel displays pop up automatically on the flight display for the aircrew during the approach to the runway.

* * * * *